US006339890B1

(12) United States Patent
Farah et al.

(10) Patent No.: US 6,339,890 B1
(45) Date of Patent: Jan. 22, 2002

(54) MULTIPLE POSITION EASEL MAT

(75) Inventors: Robert N. Farah; Thomas J. Kanouse, both of El Paso, TX (US)

(73) Assignee: Gross Manufacturing Corporation, El Paso, TX (US)

( * ) Notice: Subject to any disclaimer, the term of this patent is extended or adjusted under 35 U.S.C. 154(b) by 0 days.

(21) Appl. No.: 09/491,226

(22) Filed: Jan. 25, 2000

(51) Int. Cl.[7] ..... A47G 1/01

(52) U.S. Cl. ..... 40/750; 40/752; 40/755; 40/124.17

(58) Field of Search ..... 40/750, 752, 754, 40/755, 120, 124.17, 124.18, 757, 774, 775, 75

(56) References Cited

U.S. PATENT DOCUMENTS 1,629,670 A * 5/1927 Malme ..... 40/124.09
4,965,946 A 10/1990 Hegedus et al. ..... 40/124.4
5,303,487 A 4/1994 Olson ..... 40/124.1
5,337,949 A 8/1994 Seeley ..... 229/92.8
5,361,521 A 11/1994 Burtch ..... 40/152.1
5,365,684 A 11/1994 Cartmell et al. ..... 40/155
5,513,455 A 5/1996 Walker ..... 40/788
5,678,339 A 10/1997 Marventano ..... 40/789
5,950,341 A 9/1999 Cross ..... 40/750

* cited by examiner

*Primary Examiner*—C. Davis
(74) *Attorney, Agent, or Firm*—Brinks Hofer Gilson & Lione

(57) ABSTRACT

A multiple position easel mat or frame for photographs and the like includes a frame portion having one or more openings and a pocket which receives photographs, pictorial or printed material having configurations generally corresponding to the size and shape of the openings in the frame and a support portion which includes a pair of flaps having interengaging tabs and slots. The flaps of the support portion are configured to support the frame in either a vertical or a horizontal orientation to accommodate the orientation of the photographs, pictorial or printed material.

19 Claims, 3 Drawing Sheets

MULTIPLE POSITION EASEL MAT

BACKGROUND OF THE INVENTION

The invention relates generally to frames or mats for photographs and the like and more particularly to an easel mat or frame having a support structure which facilitates orientation of the frame either vertically or horizontally.

Frames for photographs, pictorial and printed material are configured and manufactured in styles nearly as numerous as the types of material they accept. Wood and metal section frames typically include glass to protect the material contained therein and are generally hung on walls. Frames which are smaller in scale and intended for table or desk top display may also be constructed of such materials. Such frames are frequently maintained in an oblique position by a pivoted support secured to the back of the frame.

A third class of products include frames which are manufactured of cardboard or heavy paper stock. Such frames or mats generally include two or more panels or layers of material which define a pocket into which is slid and positioned the photographs, pictorial and printed material. Given the great variety of photographic formats and print sizes as well as the acknowledged need to accept material which is rectangular and which may have widely varying aspect ratios, openings in such frames are often rectangular.

Square openings may also be included in such frames. Whereas square frame openings are orientation insensitive, that is, they accept square pictorial material when oriented in either a vertical or horizontal orientation, a frame having a rectangular opening for a rectangular photograph must be oriented to display the photograph, pictorial or printed material in its proper orientation. That is, whereas a square frame may simply be supported and oriented in one orientation as any square photograph may be properly installed therein, a rectangular frame or a frame including a rectangular opening must be capable of orientation matching that of the rectangular photograph, pictorial or printed pictorial material to display it properly.

The present invention is directed to a frame or mat having a support structure which enables selective positioning in either a vertical or horizontal orientation.

SUMMARY OF THE INVENTION

A multiple position easel mat or frame for photographs and the like includes a frame portion having one or more openings and a pocket which receives photographs, pictorial or printed material having configurations generally corresponding to the size and shape of the openings in the frame and a support portion which includes a pair of flaps having interengaging tabs and slots. The frame portion comprises a front and a back panel which are secured together to define the pocket. Preferably, the flaps are integral portions of the front and back panels. The flaps of the support portion are configured and, when engaged, disposed to support the frame in either a vertical or a horizontal orientation to accommodate the orientation of the photographs, pictorial or printed material.

It is thus an object of the present invention to provide an easel mat or frame for photographs and the like which may be positioned either vertically or horizontally.

It is a further object of the present invention to provide an easel mat or frame for photographs and the like having a support structure which readily supports the mat or frame in a vertical or horizontal orientation.

It is a still further object of the present invention to provide an easel mat or frame having a pair of flaps including interengaging tabs and slots which support the frame in either a vertical or horizontal orientation.

It is a still further object of the present invention to provide an easel mat or frame having a front panel and a rear panel which define a pocket for photographs and the like and a pair of flaps which are integral with the panels.

Further objects and advantages of the present invention will become apparent by reference to the following description of the preferred embodiment and appended drawings wherein like reference numbers refer to the same component, element or feature.

DESCRIPTION OF THE PREFERRED AND ALTERNATE EMBODIMENTS

Figure 1:
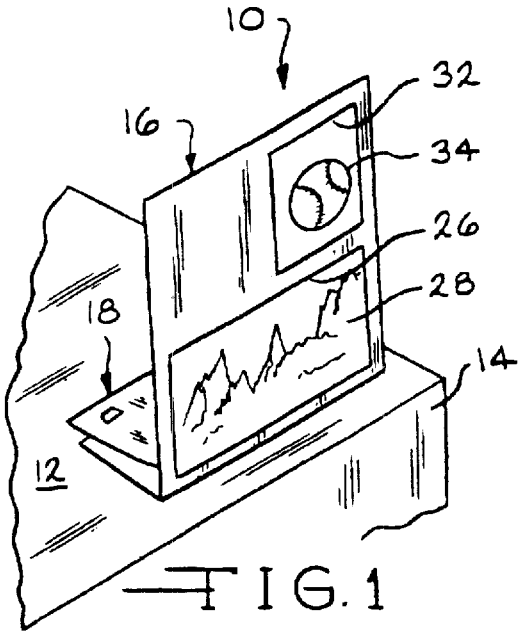
FIG. 1 is a front, perspective view of an easel mat or frame according to the present invention disposed vertically to display a photograph having a longer horizontal axis.
Figure 2:
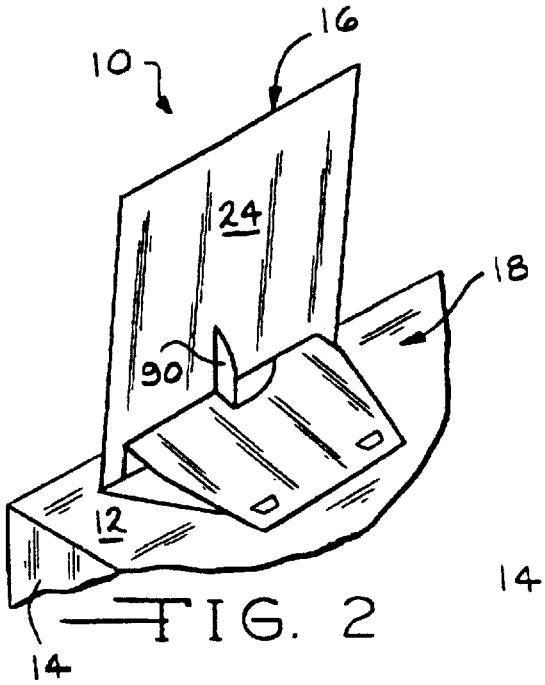
FIG. 2 is a rear, perspective view of an easel mat or frame according to the present invention in a vertical orientation.
Figure 5:
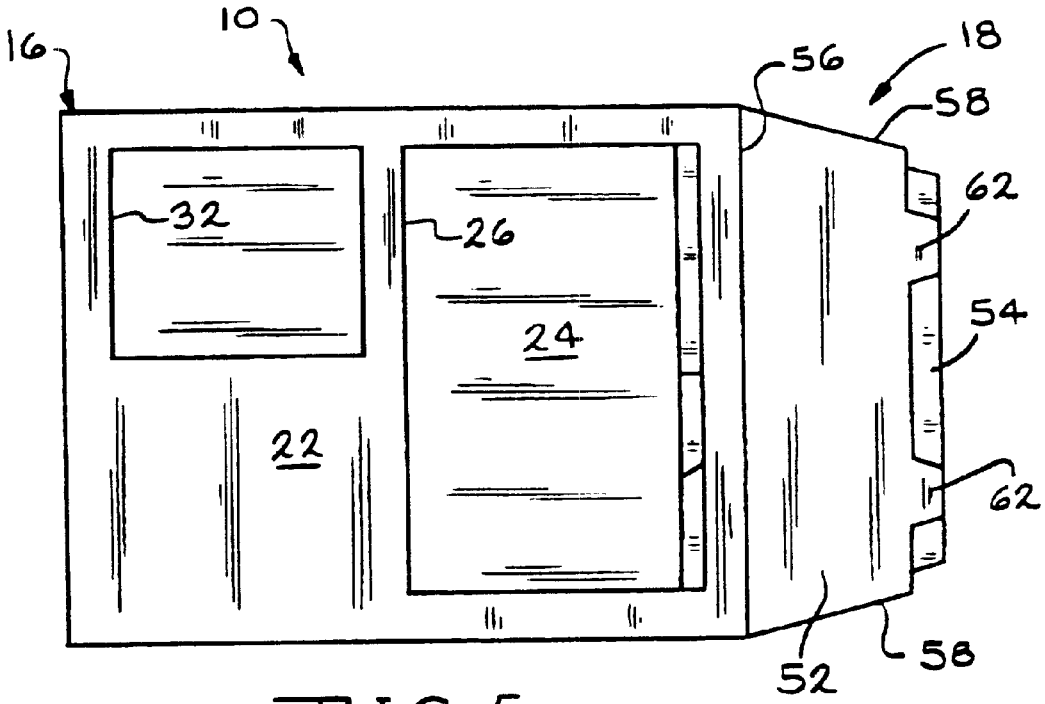
FIG. 5 is a front, elevational view of an easel mat or frame according to the present invention in preassembly configuration.

Referring now to FIGS. 1, 2, and 5, a multiple position easel mat or frame according to the present invention is designated by the reference numeral 10. The easel mat or frame 10 is disposed in a vertical orientation and is preferably supported on a horizontal surface 12 of a desk, cabinet, shelf, table or other furniture 14. The easel mat or frame 10 includes a frame portion 16 and a support portion 18. The frame portion 16 comprises a front panel 22 and a rear panel 24 of heavy paper or cardboard stock. The frame 10 may be formed by folding along one edge and the application of an adhesive along the edge opposite from the fold and one shorter edge or may be fabricated of two separate panels of heavy paper or cardboard stock which are secured together by an adhesive along all but one edge. The front panel 22 includes at least one large rectangular opening or cutout 26 to receive a similarly sized photograph 28, pictorial or printed material. The photograph 28 of, for example, landscape has its long axis disposed horizontally. The frame portion 16 and specifically the front panel 22 may also include one or more square, circular, oval, rectangular, or any polygonal shaped openings or cutouts 32 which receive square or slightly rectangular photographs such as a photograph 34 of a souvenir.

Figure 3:
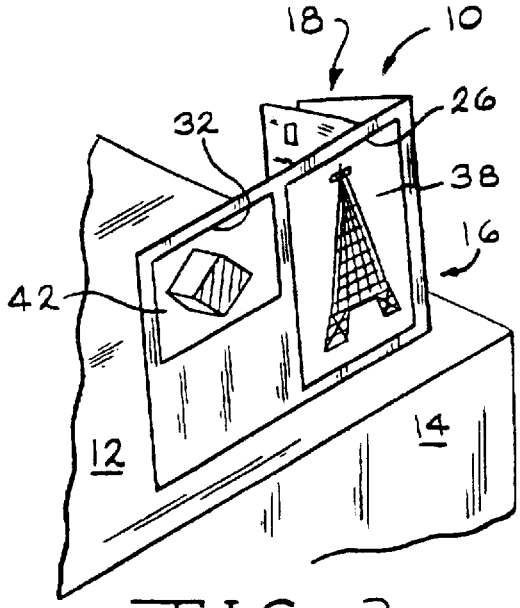
FIG. 3 is a front, perspective view of an easel mat or frame according to the present invention disposed horizontally to display a photograph having a longer vertical axis.
Figure 4:
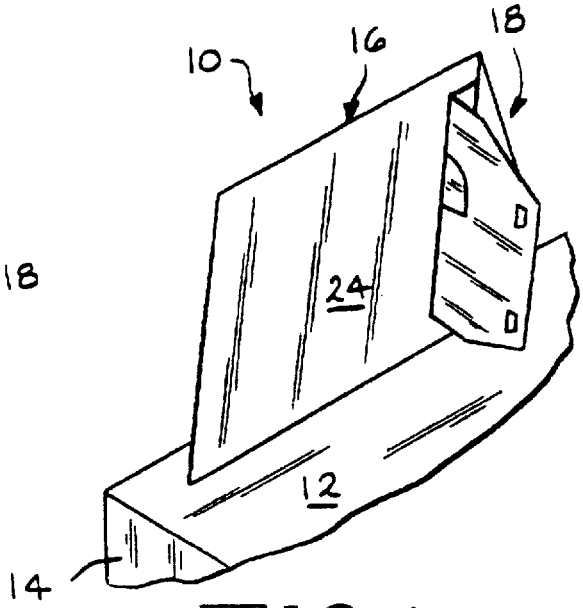
FIG. 4 is a rear, perspective view of an easel mat or frame according to the present invention in a horizontal orientation.

FIGS. 3 and 4 present the easel mat or frame 10 according to the present invention in a horizontal orientation on the surface 12 of the furniture 14. Here, a photograph 38 having its long axis disposed vertically is positioned within the rectangular opening or cutout 26 of the easel mat or frame 10. The square or slightly rectangular cutout 32 accepts another photograph 42 or pictorial material which is either square or slightly rectangular.

It will be appreciated, particularly when viewing FIGS. 2 and 4, that the support portion 18 provides suitable support to the frame portion 16 such that the frame portion 16 is disposed at an attractive, aesthetic angle from the vertical either in the vertical orientation illustrated in FIGS. 1 and 2 or the horizontal orientation illustrated in FIGS. 3 and 4. It will also be appreciated that the rectangular opening or cutout 26 which has its long axis oriented perpendicularly to the long axis of the frame portion 16 is presented by way of example and illustration only. A frame portion 16 having a rectangular opening 26 with its long axis parallel to the longer dimension of the frame portion 16 is a configuration also comprehended by the inventors. Finally, it should be appreciated that while FIGS. 3 and 4 illustrate the easel mat or frame 10 according to the present invention lying on what may be denominated its left side as it appears in FIG. 1, the support portion 18 is symmetrical about the longer center line of the frame 10 and thus it may be readily disposed on what may be denominated its right side as illustrated in FIG. 1. Thus, the easel mat or frame 10 of the present invention may be disposed in any one of three orientations.

Figure 6:
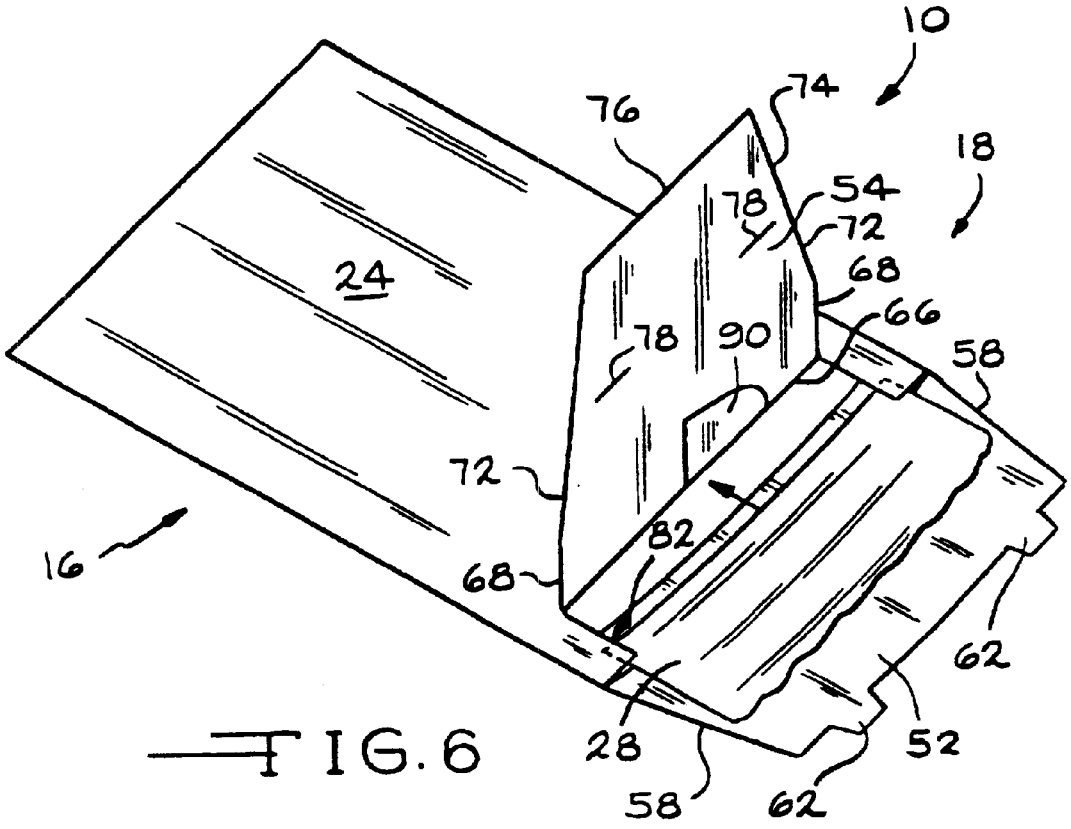
FIG. 6 is a perspective view of the back of an easel mat or frame according to the present invention illustrating the insertion of a photograph.
Figure 7:
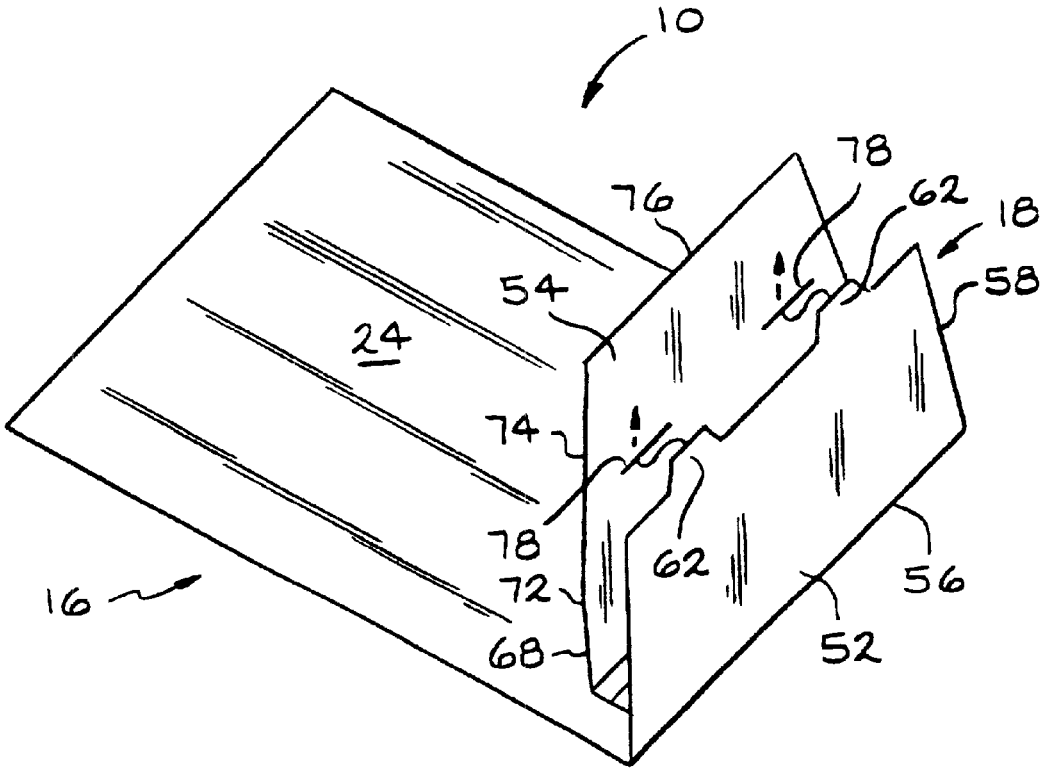
FIG. 7 is a perspective view of the back of an easel mat or frame according to the present invention illustrating the positioning and assembly of the two flaps.

Turning now to FIGS. 5, 6 and 7, the support portion 18 of the easel mat or frame 10 includes a first, front or smaller flap 52 and a second, rear or larger flap 54. The first, smaller flap 52 is trapezoidal in shape and is preferably an integral portion or extension of the front panel 22. A fold or crease line 56 is preferably formed in the heavy paper or cardboard stock to facilitate uniform and accurate folding along the line representing the common edges of the front panel 22 and the first, smaller flap 52. Extending from the fold line 56 at an angle of approximately 15° are two oblique, mirror-image edges 58. The first, smaller flap 52 terminates in male connectors such as a pair of spaced apart, trapezoidal tabs or projections 62.

The second, larger flap 54 is likewise an integral portion or extension of the rear panel 24. Again, a fold or crease line 66 is preferably formed at the juncture of the rear panel 24 and the second, larger flap 54 to ensure uniform and accurate folding. The second, larger flap 54 defines mirror image edges extending from the crease line 66 which define a straight portion 68, a knee 72 and an oblique portion 74. The oblique portion 74 forms an angle of approximately 5° to 10° relative to the straight portion 68. Slightly over half the distance from the crease line 66 to a terminal edge 76 of the second, larger flap 54 are female connectors such as a pair of aligned, spaced apart slots 78 having a length slightly greater than the base width of the pair of trapezoidal tabs 62 and spacing which corresponds to the spacing of the pair of tabs 62.

As illustrated in FIGS. 6 and 7, appropriate photographs such as the photograph 28 are slid into the pocket 82 defined by and disposed between the front panel 22 and the back panel 24 such that the photograph(s) are properly arranged, aligned and positioned within the openings or cutouts 26 and 32. Next, the first, smaller flap 52 and the second, larger flap 54 are creased and folded along the crease lines 56 and 66 generally into the positions illustrated in FIG. 7. The trapezoidal tabs 62 are then inserted into the respective, aligned slots 78 and the flaps 52 and 54 are allowed to relax. The easel mat or frame 10 may then be disposed in either the vertical position illustrated in FIGS. 1 and 2 or the horizontal position illustrated in FIGS. 3 and 4 (or the reverse horizontal position) so that the photograph in the rectangular opening or cutout 26 is properly oriented. In either orientation, the easel mat or frame 10 is positioned and maintained at a slight oblique angle from the vertical on the surface 12 which is both aesthetically pleasing and which assists viewing of the photographs 28, 34, 38 and 42, pictorial or printed material displayed therein.

As an optional or alternative construction, the second or larger flap 54 may include a die cut, fold-out support tab 90 which may be folded out from the second or larger flap 54 to assist support of the frame assembly 16 as illustrated in FIG. 2. It should be appreciated, however, that the fold-out support tab 90 is optional and that the construction of the easel mat or frame assembly 10 from sufficiently heavy paper or cardboard stock will generally eliminate the need for the support tab 90.

It will thus be appreciated that an easel mat or frame 10 according to the present invention is readily disposed in either a vertical or a horizontal position. In either position, the easel mat or frame 10 is inclined at a small angle from the vertical to aesthetically display photographs, pictorial or printed material.

It should also be appreciated that, as is often the case with-slot and tab fasteners, their locations may be exchanged if desired and that other connection or attachment means may be substituted for such features while still embodying the present invention.

Lastly, it should be appreciated that the support portion 18 and specifically the flaps 52 and 54 facilitate disposition in three orientations: vertically as illustrated in FIGS. 1 and 2 and horizontally on either its left side as illustrated in FIGS. 3 and 4 or its right side as a user sees fit.

The foregoing disclosure is the best mode devised by the inventors for practicing this invention. It is apparent, however, that apparatus incorporating modifications and variations will be obvious to one skilled in the art of display frames and mats. Inasmuch as the foregoing disclosure presents the best mode contemplated by the inventors for carrying out the invention and is intended to enable any person skilled in the pertinent art to practice this invention, it should not be construed to be limited thereby but should be construed to include such aforementioned obvious variations and be limited only by the spirit and scope of the following claims.

We claim:

1. A multiple position frame for pictorial or printed material comprising, in combination, a frame portion having a front panel defining three edges and an end and a rear panel defining three edges and an end adjacent said end of said front panel, said front panel defining at least one opening for displaying such pictorial or printed material, said panels secured together along said three edges, and a support portion having a first flap extending from one of said ends and a second flap extending from another of said ends, said first flap including a pair of spaced apart projections, said second flap including a pair of spaced apart slots, whereby said pair of projections may be disposed in said pair of slots and said frame may be appropriately disposed to accommodate such pictorial or printed material.

2. The multiple position frame of claim 1 wherein said flaps are integral portions of said panels.

3. The multiple position frame of claim 1 wherein said first flap is an integral portion of said front panel and said second flap is an integral portion of said rear panel.

4. The multiple position frame of claim 1 further including creases defining junctions between said front panel and said first flap and said rear panel and said second flap.

5. The multiple position frame of claim 1 wherein said opening in said front panel is rectangular and said front panel defines at least one additional opening.

6. The multiple position frame of claim 1 further including a support tab cut in said second flap adjacent a crease line.

7. The multiple position frame of claim 1 wherein said frame rests generally on said first flap in a vertical position.

8. The multiple position frame of claim 1 wherein said frame rests generally on an edge of said frame and an edge of said second flap in a horizontal position.

9. A multiple position easel mat for pictorial or printed material comprising, in combination, a frame portion having a front panel having three edges and an end and a rear panel having three edges and an end adjacent said respective edges and end of said front panel, said front panel defining at least one opening for displaying such pictorial material, and a support portion having a first flap extending from said end of said front panel and a second flap extending from said end of said rear panel, said first flap including one of a pair of spaced apart tabs and slots, said second flap including another of said pair of spaced apart tabs and slots, whereby one of said pair of tabs may be disposed in a respective one of said pair of slots and said frame may be disposed vertically or horizontally to accommodate such pictorial or printed material.

10. The multiple position easel mat of claim 9 further including creases defining junctions between said front panel and said first flap and said rear panel and said second flap.

11. The multiple position easel mat of claim 9 wherein said front panel defines at least one additional opening.

12. The multiple position easel mat of claim 9 further including a support tab cut in said second flap adjacent a crease line.

13. The multiple position easel mat of claim 9 wherein said flaps are integral portions of said panels.

14. A multiple position mounting for pictorial or printed material comprising, in combination, a frame having a front panel including three edges and end and a rear panel including three edges and an end adjacent said end of said front panel, said front panel defining at least one rectangular opening for displaying such pictorial or printed material, said front panel secured to said rear panel along said three edges to define an interior pocket accessible at said adjacent ends of said frame, and a support having a first flap extending from one of said ends and a second flap extending from another of said ends, said first flap including male connectors, said second flap including female connectors adapted to receive said male connectors, whereby said male connectors may be disposed in said female connectors and said mounting may be disposed vertically or horizontally to accommodate such pictorial or printed material.

15. The mounting of claim 14 wherein said flaps are integral portions of said panels.

16. The mounting of claim 14 wherein said first flap is an integral portion of said front panel and said second flap is an integral portion of said rear panel.

17. The mounting of claim 14 further including creases defining junctions between said front panel and said first flap and said rear panel and said second flap.

18. The mounting of claim 14 wherein said front panel defines at least one additional opening.

19. The mounting of claim 14 wherein said male connectors define a pair of spaced apart tabs and said female connectors define a pair of spaced apart slots.

* * * * *